United States Patent [19]

Knierim et al.

[11] Patent Number: 4,613,950

[45] Date of Patent: Sep. 23, 1986

[54] SELF-CALIBRATING TIME INTERVAL METER

[75] Inventors: Daniel G. Knierim; Lee J. Jalovec, both of Beaverton, Oreg.

[73] Assignee: Tektronix, Inc., Beaverton, Oreg.

[21] Appl. No.: 534,854

[22] Filed: Sep. 22, 1983

[51] Int. Cl.[4] ..... G04F 7/06

[52] U.S. Cl. ..... 364/569; 340/347 NT; 377/20; 364/571

[58] Field of Search ..... 364/569, 571; 377/107, 377/110, 20, 19; 328/129.1; 340/347 NT

[56] References Cited

U.S. PATENT DOCUMENTS

| | | | |
|---|---|---|---|
| 3,878,370 | 4/1975 | Santomango et al. | 377/20 |
| 3,920,961 | 11/1975 | Berg | 377/20 |
| 4,303,880 | 12/1981 | Munt et al. | 340/347 NT |
| 4,303,983 | 12/1981 | Chaborski | 364/569 |
| 4,395,701 | 7/1983 | Evans | 340/347 NT |
| 4,468,746 | 8/1984 | Davis | 364/569 |
| 4,523,289 | 6/1985 | Soma et al. | 377/20 |

*Primary Examiner*—Parshotam S. Lall
*Attorney, Agent, or Firm*—Allston L. Jones; Daniel J. Bedell

[57] ABSTRACT

A self-calibrating time interval meter including means for measuring time intervals using a dual-speed ramp technique. The time interval meter operates in a measurement mode to measure time intervals and operates in a calibration mode for calibration adjustments. In measurement mode, the time interval meter utilizes a dual-speed ramp technique to expand the time interval to be measured. A capacitor is rapidly charged by a first constant current source during the time interval to be measured, and is then slowly discharged by a second constant current source. The time required to discharge the capacitor is measured and utilized to compute a measurement of the time interval. In calibration mode, a flip-flop is alternately switched into and out of the circuit to provide two time interval measurements that differ by exactly one clock period of a known clock signal. A microprocessor subtracts the two measurements and compares the difference to the known clock period to determine a calibration error. The microprocessor, through a digital-to-analog converter, varies the current flow of the first constant current source to minimize the calibration error by compensating for drift in the current sources.

25 Claims, 6 Drawing Figures

SELF-CALIBRATING TIME INTERVAL METER

BACKGROUND OF THE INVENTION

The present invention relates generally to devices for measuring time intervals, and relates more particularly to a dual-speed ramp time interval meter including circuitry for automatic calibration.

Time interval meters for measuring time intervals in the sub-microsecond range have existed in the prior art. One such time interval meter is disclosed in U.S. Pat. No. 4,301,360 issued Nov. 17, 1981 to Bruce W. Blair and entitled "Time Interval Meter." The Blair time interval meter utilized a capacitor and two constant current sources to charge the capacitor to a predetermined reference voltage in two stages, a fast ramp period followed by a slow ramp period. During the fast ramp period, equal in duration to the time interval to be measured, the capacitor was rapidly charged by a first constant current source. After the end of the time interval, the first constant current source was switched off to end the fast ramp period and a second constant current source was switched on to begin the slow ramp period. During the slow ramp period, the capacitor continued to charge at a slower rate until the reference voltage was reached. The time duration of the slow ramp period was measured by counting pulses of a constant frequency clock and then multipling by the ratio of the two currents to obtain a measurement of the time interval. The Blair time interval meter thus utilized a dual-speed ramp technique to measure short time intervals.

The measurement accuracy of dual-speed ramp time interval meters is dependent upon the stability of the constant current sources. In calculating the measured time interval, the measured duration of the slow ramp period is multiplied by the ratio of the currents of the two constant current souces. This ratio is predetermined according to the nominal operation of the two current sources and is assumed to have a constant value. Any change in the actual current flow of either constant current source changes the actual ratio of the currents and, accordingly, the relationship between the durations of the fast and slow ramp periods. Since the ratio is assumed to be constant, such a change in the actual ratio will result in erroneous time interval measurements. Changes in the operation of the constant current sources can occur, for example, due to changes in temperature.

The measurement accuracy of dual-speed ramp time interval meters that charge a capacitor to a reference voltage is also dependent upon the stability of the capacitor and of the reference voltage. Even if the ratio of the currents is stable, variations in the capacitance of the capacitor or in the reference voltage will affect the relationship between the durations of the fast and slow ramp periods and, accordingly, the accuracy of the measured time interval.

It would be desirable, therefore, to provide means for accurately calibrating time interval meters to compensate for changes in the operation of constant current sources utilized therein. It is also desirable to provide a time interval meter having a measurement accuracy that is not dependent upon the stability of capacitors or reference voltages.

SUMMARY OF THE INVENTION

In accordance with the illustrated preferred embodiment, the present invention provides a self-calibrating time interval meter including means for measuring time intervals using a dual-speed ramp technique. The time interval meter measures time intervals between a triggering start signal and a pulse of a clock signal. The time intervals within the measurable range of the time interval meter are short in duration, and may range, for example, from one half to one and one half clock periods. The self-calibrating time interval meter according to the preferred embodiment of the present invention includes clocking means, a dual speed ramp circuit, measurement means, calibration means, and adjustment means.

Clocking means are provided to generate a stop signal that is synchronized to a pulse of the clock signal. The stop signal is generated at the first falling edge of the clock signal that occurs subsequent to one half clock period after the receipt of the start signal.

The dual speed ramp circuit utilizes a dual-speed ramp technique to expand the time interval to be measured to allow for more accurate measurement. Included in the dual speed ramp circuit are a capacitor and first and second constant current sources coupled to the capacitor for, respectively, charging and discharging the capacitor. Prior to the receipt of the start signal, the capacitor is clamped to ground. Upon the receipt of the start signal, the first constant current source charges the capacitor at a fast ramp rate. When the stop signal is received, the first constant current source is switched off to end the capacitor charging phase. The duration of the period of operation at the fast ramp rate is equal to the time interval to be measured. After the receipt of the stop signal, the second constant current source begins to drain the accumulated charge from the capacitor at a slow ramp rate. The period of operation at the slow ramp rate continues until the charge on the capacitor equals ground potential. Since the rate of current flow of the second constant current source is proportionally less than that of the first constant current source, the duration of the slow ramp period discharging the capacitor is proportionally greater than the duration of the fast ramp period charging the capacitor. Therefore, the duration of the slow ramp period is a proportional expansion of the time interval between the start and stop signals, and is proportionally greater by an amount equal to the ratio of the currents of the first and second constant current sources.

The measurement means computes a value for the measured time interval according to the duration of the slow ramp period. A counter within the measurement means measures the duration of the slow ramp period by counting clock pulses during the slow ramp period. A microprocessor computes the measured time interval from the measurement of the duration of the slow ramp period by multiplying it by the ratio of the currents of the second and first constant current sources, respectively.

During time interval measurements, the calibration means is not utilized. When the time interval meter requires calibration, however, the calibration means is switched into operation. The calibration means supplies a time interval measurement of the known clock period as an indication of the actual operation of the meter circuitry. The calibration means includes a multiplexer that is coupled to the clocking means and is operable for selectively connecting a flip-flop to the clocking means. When the flip-flop is connected, the generation of the stop signal by the clocking means is delayed by one clock period. Two measurements are taken, one with the flip-flop disconnected and the other with the flip-flop connected. The microprocessor subtracts the two measurements to yield a clock period measurement, and compares it to the known clock period determine a calibration error.

The microprocessor, coupled to the dual-speed ramp circuit through a digital-to-analog converter, provides adjustment means to allow the time interval meter to selfcalibrate. The output of the digital-to-analog converter controls the current flow of the first constant current source. After determining the calibration error, the microprocessor adjusts the current flow of the first constant current source to minimize the error.

DESCRIPTION OF THE PREFERRED EMBODIMENT

The preferred embodiment of the present invention is a self-calibrating time interval meter for measuring elapsed time between a trigger signal and a subsequent pulse of a clock signal. The present invention is useful for accurately measuring time intervals for digitizing information in digital oscilloscopes. The present invention operates in two modes: a time interval measurement mode, and a calibration mode. The calibration mode is entered periodically to check and, if necessary, adjust the operation of the time interval meter to improve measurement accuracy.

Figure 1:
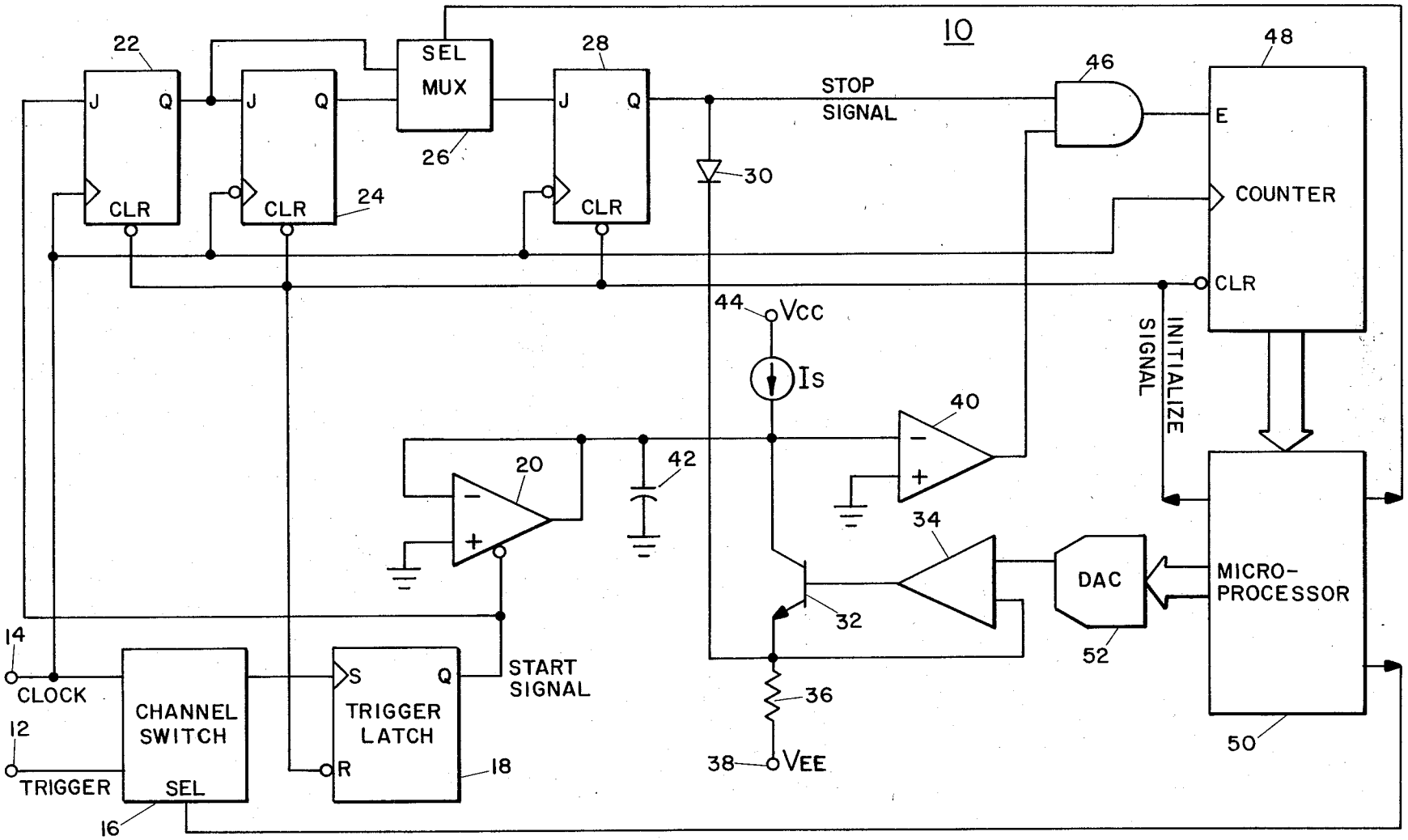
FIG. 1 is a schematic diagram of a self-calibrating time interval meter according to the present invention.

In reference now to FIG. 1, there is shown a self-calibrating time interval meter 10 according to the present invention. First, the electronic circuitry interconnecting the electronic components of the time interval meter will be described. Then the operation of the time interval meter in the measurement mode will be described in reference to FIGS. 2 and 3. Next, the operation of the time interval meter in the calibration mode will be described in reference to FIG. 4. Finally, an alternative embodiment of a portion of the time interval meter will be described in reference to FIG. 5.

FIG. 1 schematically illustrates the circuitry of the time interval meter 10. The time interval meter measures the elapsed time between the receipt of a trigger signal applied to terminal 12 and a subsequent pulse of a clock signal applied to terminal 14. Both the trigger signal and the clock signal are applied to the inputs of a channel switch 16. The output of channel switch 16 is connected to the set input of a trigger latch 18. The Q output of trigger latch 18 is connected to the enable iput of a comparator 20, and is also connected to the J input of a first flip-flop 22. The Q output of flip-flop 22 is connected to both the J input of a second flip-flop 24 and to one input of a multiplexer 26. The other input of multiplexer 26 is connected to the Q output of flip-flop 24. Multiplexer 26 has its output connected to the J input of a third flip-flop 28. A stop signal is generated by flip-flop 28 at its Q output. The clock signal that is applied to terminal 14 is also applied to the clock inputs of flip-flop 22, 24, and 28. Flip-flop 22 is clocked on a rising edge of the clock signal, while flip-flops 24 and 28 are clocked on a falling edge of the clock signal. Flip-flops 22, 24, and 28 are preferably JK flip-flops with the K inputs grounded.

A diode 30 has its anode connected to the Q output of flip-flops 28 and has its cathode connected to the common connection among the emitter of an NPN transistor 32, an input to an operational amplifier 34 and one side of a resistor 36. The other side of resistor 36 is connected to terminal 38, to which negative voltage VEE is applied. Transistor 32 has its base connected to the output of operational amplifier 34 and has its collector connected to the common connection among a slow rate current source $I_S$, the inverting (−) input of a comparator 40, one side of a capacitor 42, the inverting (−) input of comparator 20, and the output of comparator 20. Comparator 20 has its noninverting(+)input connected to ground, while comparator 40 has its noninverting (+) input connected to ground. Current source $I_S$ conducts current to capacitor 42 from terminal 44, to which positive voltage VCC is applied. Transistor 32 and current source $I_S$ act as first and second constant current sources to respectively charge and discharge capacitor 42.

Both the output of comparator 40 and the stop signal are applied to the inputs of an AND gate 46. The output of AND gate 46 is connected to the enable input of a counter 48. The output of counter 48 is connected to an input port of a microprocessor 50, while the clock input of the counter is connected to the clock signal of terminal 14.

Microprocessor 50 performs control and computational functions for the time interval meter. It generates an initialization signal that is applied to the clear inputs of flip-flops 22, 24, and 28, to the clear input of counter 48, and to the reset input of trigger latch 18. Microprocessor 50 is also connected to the select input of multiplexer 26 and to the select input of channel switch 16 for switching between measurement mode and calibration mode. To adjust the current flow through transistor 34 during the calibration mode, the microprocessor is coupled to a digital-to-analog converter 52, which in turn is connected to an input of operational amplifier 34.

Figure 2:
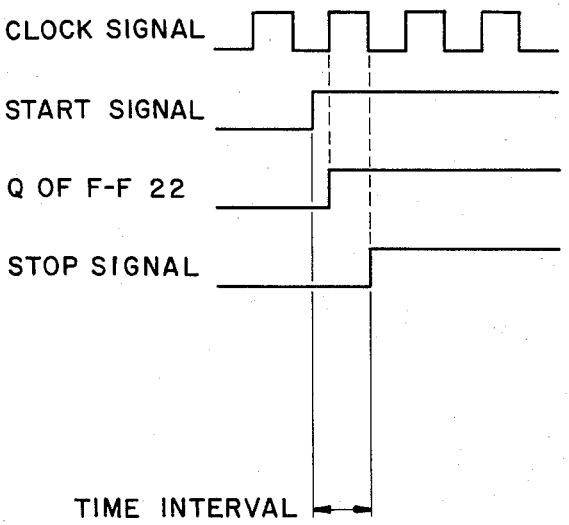
FIG. 2 is a timing diagram of the operation of the time interval meter of FIG. 1 during time interval measurement.

Functionally, the time interval meter comprises clocking means, a dual-speed ramp circuit, measurement means, calibration means, and adjustment means. Trigger latch 18 and flip-flops 22 and 28 comprise the clocking means that synchronizes the stop signal with a pulse of the clock signal. When the time interval meter is operating in the measurement mode, channel switch 16 connects the trigger signal to the set input of the trigger latch, and multiplexer 26 connects the Q output of flip-flop 22 to the J input of flip-flop 28. When the trigger signal goes to a logic high level, signifying the beginning of the time interval to be measured, the trigger latch latches the start signal to a logic high level. As shown in FIG. 2, the Q output of flip-flop 22 goes to a logic high level at the next rising edge of the clock signal. Since the output of flip-flop 22 is connected to the J input of flip-flop 28, the output of flip-flop 28 (stop signal) goes to a logic high level at the next following falling edge of the clock signal. Thus, the stop signal shifts from a logic low level to a logic high level at the first falling edge of the clock signal following the first rising edge after the receipt of the start signal. The elapsed time between the rising edge of the start signal and the rising edge of the stop signal is equal to the time interval to be measured.

Figure 3:
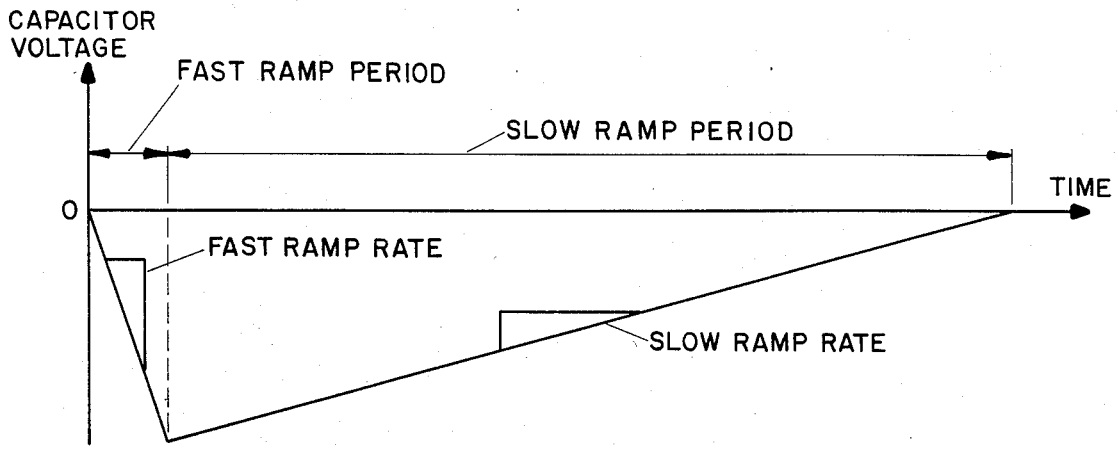
FIG. 3 is a graphical representation of the voltage of a capacitor of the time interval meter of FIG. 1 during a charging and discharging cycle.

The dual-speed ramp circuit expands the duration of the time interval to be measured to allow for more accurate measurement. To accomplish this, the dual-speed ramp circuit charges capacitor 42 from a known starting point at a fast charging rate during the time interval to be measured, and then discharges the capacitor at a slower rate until the starting point is again reached. Let us call the charging rate as the fast ramp rate, the time interval to be measured as the fast ramp period, the discharging rate as the slow ramp rate, and the expanded time interval as the slow ramp period. These terms are illustrated in FIG. 3. Since the charge on the capacitor begins and ends at the same point (zero net charge), the ratio of the fast ramp period to the slow ramp period is equal to the ratio of the slow ramp rate to the fast ramp rate. The dual-speed ramp circuit comprises capacitor 42, comparators 20 and 40, slow rate current source $I_S$, and a fast rate current source that includes transistor 32, operational amplifier 34, and resistor 36. The fast and slow rate current sources are, respectively, the first and second constant current sources mentioned above.

Prior to the receipt of the start signal, comparator 20 is enabled and clamps capacitor 42 to ground. Also during this time, current sources IS and transistor 32 are on and conducting their respective slow and fast rate currents, and microprocessor 50 clears the counter and the flip-flops, and resets the trigger latch. Upon the receipt of the start signal, comparator 20 is disabled, releasing the capacitor from ground potential. Since the fast rate current through transistor 32 is greater than the slow rate current supplied by current source $I_S$, transistor 32 drains charge from the capacitor. Transistor 32 continues to negatively charge capacitor 42 until the stop signal is generated. When that happens, the stop signal switches to a logic high level, which reverse biases the base and emitter of transistor 32 and causes the transistor to turn off. From this point onward, the slow rate current flows into the capacitor to negatively discharge it. Since the current of the slow rate current source is less than the fast rate current of transistor 32, the slow ramp period is proportionally longer than the fast ramp period. The capacitor continues to discharge until it reaches ground potential, whereupon comparator 40 indicates the end of the slow ramp period.

Counter 48, AND gate 46, and microprocessor 50 provides measurement means for measuring the slow ramp period and for computing the measured time interval. Both the output of comparator 40 and the stop signal must be at logic high level to enable the counter. Both are high when the stop signal goes high at the end of the time interval, and remain high until the capacitor reaches ground potential at the end of the slow ramp period. Thus, the counter is enabled during the entire slow ramp period, which it measures by counting the pulses of the clock signal. The microprocessor computes the measured time interval by multiplying the number of clock pulses counted during the slow ramp period times a predetermined number equal to the period of the clock signal multiplied by the ratio of the slow to fast rate currents.

The predetermined number is calculated from the known clock period and the slow and fast rate currents and is stored within the microprocessor. Since the operation of the slow and fast current sources may vary according to environmental conditions such as temperature, the predetermined number is, in effect, an estimate of the nominal operation of the time interval meter. The calibration means and adjustment means are provided to compensate for such variations to reduce measurement error.

Figure 4:
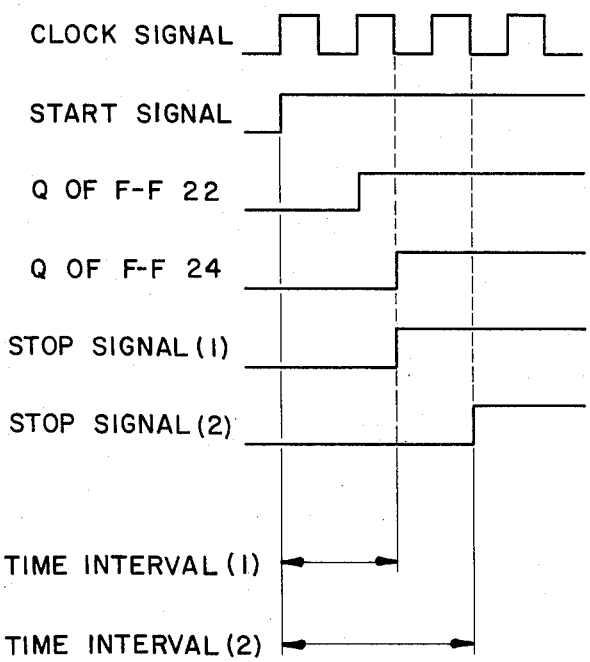
FIG. 4 is a timing diagram of the operation of the time interval meter of FIG. 1 during calibration.

The calibration means comprises channel switch 16, flip-flop 24, multiplexer 26, and microprocessor 50. To enter the calibration mode, the microprocessor switches channel switch 16 to connect the clock signal to the set input of trigger latch 18. With the multiplexer connecting the output of flip-flop 22 to the input of flip-flop 28, a time interval measurement is taken. Due to propagation delays through the trigger latch, flip-flop 22 will clock on the second rising edge of the clock signal. The corresponding stop signal (1) will occur at the second falling edge of the clock signal. This time interval, shown as time interval (1) in FIG. 4, is nominally one and one half clock periods in length. Its duration is not precisely known due to the propagation delays in the trigger latch and the flip-flops.

Next, the multiplexer is switched to connect the output of flip-flop 24 to the input of flip-flop 28 and another time interval (time interval (2)) is measured. As before, flip-flop 22 clocks on the second rising edge of the clock signal. However, flip-flop 24 clocks on the second falling edge of the clock signal and flip-flop 28 clocks on the third falling edge of the clock signal. Thus, the effect of switching the input of flip-flop 28 to the output of flip-flop 24 is that stop signal (2) is delayed by exactly one clock period and, therefore, time interval (2) is exactly one clock period longer than time interval (1). Variations in the propagation delays through the clocking and calibration means may effect the duration of time intervals (1) and (2), however, both time intervals are effected equally and the difference between the two is always equal to one clock period.

The microprocessor measures the duration of both time interval (1) and time interval (2) by the method described above, and computes a clock period measurement that equals the difference between the two. If the time interval meter 10 is in perfect calibration, the clock period measurement will equal the known clock period. If not, the difference between the clock period measurement and the known clock period is equal to a calibration error. Any such calibration error between the two can be attributed to variations in the operation of the dual-speed ramp circuit, such as drift in the current sources or non-linearities in the capacitor, and is independent of propagation delays through the clocking and calibration means.

The adjustment means, comprising microprocessor 50 and digital-to-analog converter 52, adjusts the fast rate current of transistor 32 to eliminate the calibration error. After the several time interval (1) and (2) measurements have been performed and an averaged calibration error computed, the microprocessor directs the digital-to-analog converter to adjust the input voltage to operational amplifier 34. This changes the fast rate current and, correspondingly, the calibration error. The calibration process continues iteratively until the calibration error is reduced below an acceptable threshold.

Figure 6:
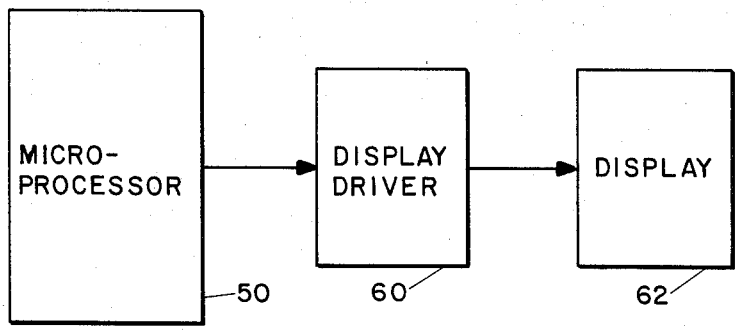
FIG. 6 is a block diagram of display circuitry driven by the microprocessor of FIG. 1 when the manual adjustment means of FIG. 5 is utilized.
Figure 5:
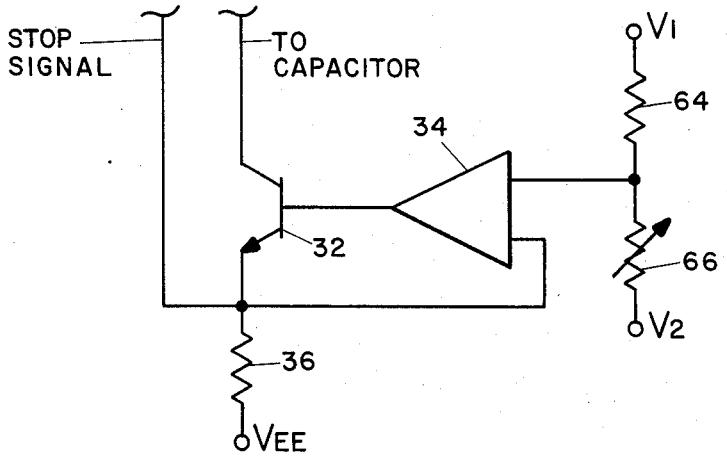
FIG. 5 is a schematic diagram of an alternative embodiment of the adjustment means portion of the present invention that incorporates manual calibration.

An alternative embodiment of the adjustment means is illustrated in FIG. 5. This alternative embodiment utilizes a manual adjustment of the transistor 32 base voltage to compensate for calibration errors. FIG. 6 is a block diagram of additional display circuitry required when the manual adjustment means of FIG. 5 is utilized. Microprocessor 50 outputs to a display driver 60 some measure of the calibration error. The display driver is coupled to a display 62, which displays a visual representation of the calibration error. Referring again to FIG. 5, a resistor 64 and a variable resistor 66 provide a voltage divider network between voltages V1 and $V_2$. The common connection between resistors 64 and 66 is coupled to one input of operational amplifier 34. The voltage of at the common connection between the resistors determines the current flowing through transistor 32. By manually adjusting variable resistor 66, an operator can change the fast rate current to compensate for calibration errors.

From the above description, it will be apparent that the invention disclosed herein provides a novel and advantageous self-calibrating time interval meter. As will be understood by those familier with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

What is claimed is:

1. A circuit for calibrating a time interval meter by establishing a known time interval, where said time interval meter is operable for measuring time intervals between the receipt of a start signal and the receipt of a stop signal, said circuit comprising:

a clock signal generator having a constant and known frequency, said clock signal periodically alternates between a logic high state and a logic low state;

sequential latch means coupled to receive said clock signal, said start signal, and a select signal for outputting said stop signal after an elapsed time interval has passed subsequent to the receipt of said start signal, wherein said select signal selects between a first elapsed time interval and a second elapsed time interval where said second elapsed time interval is one clock period longer than said first elapsed time interval, and wherein said known time interval is equal to the time difference between said first and second elapsed time intervals.

2. A circuit as in claim 1 wherein said sequential latch means comprises:

first, second, and third flip-flops coupled to said clock signal and operable for respectively outputting first, second, and third output signals equal to the respective logic states of first, second, and third input signals when said flip-flops are clocked, said first flip-flop is clocked at a rising edge of said clock signal, said second and third flip-flops are clocked at a falling edge of said clock signal, said flip-flops are interconnected such that said first output signal is equal to said second input signal, and one of said first output signal and said second output signal is equal to said third input signal, wherein said first input signal is equal to said start signal and said third output signal is equal to said stop signal; and switching means coupled to said select signal for connecting one of said first output signal and said second output signal to said third flip-flop to form said third input signal, wherein said first elapsed time interval occurs when said first output signal is connected to said third input signal and said second elapsed time interval occurs when said second output signal is connected to said third input signal, and wherein said elapsed time interval is the time between a rising edge of said first input signal and a rising edge of said third output signal.

3. A circuit as in claim 2 wherein each of the flip-flops are J-K type flip-flops having one of the input signals connected to the J input terminal thereof and a logic low voltage connected to the K input terminal thereof.

4. A circuit as in claim 2 wherein the switching means is a multiplexer having the first and second output signals connected to two input terminals thereof and having the third input signal connected to an output terminal thereof, said multiplexer is operable for connecting either said first output signal or said second output signal to said third input signal.

5. A time interval meter comprising:

a timing circuit operable at first and second predetermined rates, said second rate is proportionately slower than said first rate and has an opposite polarity;

control circuit means responsive to a start signal and a stop signal for causing said timing circuit to operate from a starting point at said first predetermined rate over a first time interval determined by the time difference between said start and stop signals, and for causing said timing circuit to operate at said second predetermined rate over a second time interval from the receipt of said stop signal until said starting point is reached;

measurement means coupled to said timing circuit for measuring said second time interval and for multiplying the result thereof by the ratio of said first and second predetermined rates to provide a measurement of said first time interval;

calibration means coupled to said timing circuit for providing a calibration time interval of known duration for measurement by said measurement means; and adjustment means coupled to said timing circuit for adjusting said ratio of said first and second predetermined rates to calibrate said time interval meter so that a measurement of said calibration time interval equals said known duration.

6. A time interval meter as in claim 5 wherein said timing circuit comprises a capacitor and first and second constant current sources coupled to said capacitor for respectively charging and discharging said capacitor, the first predetermined rate is the rate at which the capacitor is charged by said first constant current source and the second predetermined rate is the rate at which the capacitor is discharged by said second constant current source, and wherein said control circuit means comprises a first comparator and means for connecting said first constant current source to said capacitor upon receipt of said start signal, and for disconnecting said first constant current source from said capacitor upon receipt of said stop signal.

7. A time interval meter as in claim 6 wherein the measurement means comprises a counter and gate means for starting said counter upon receipt of the stop signal and for stopping said counter when the starting point is reached, and also comprises a microprocessor for computing the first time interval.

8. A time interval meter as in claim 7 wherein the gate means is a second comparator coupled to the capacitor and operable for comparing the charge of said capacitor to the charge of said capacitor at the starting point, and an AND gate having inputs coupled to the output of said second comparitor and to the stop signal and having an output coupled to the enable input of the counter.

9. A time interval meter as in claim 7 wherein the calibration means comprises:

a clock signal generator having a constant and known frequency, said clock signal periodically alternates between a logic high state and a logic low state;

sequential latch means coupled to receive said clock signal, said start signal, and a select signal for outputting said stop signal after an elapsed time interval has passed subsequent to the receipt of said start signal, wherein said select signal selects between a first elapsed time interval and a second elapsed time interval where said second elapsed time interval is one clock period longer than said first elapsed time interval, and wherein said known time interval is equal to the time difference between said first and second elapsed time intervals.

10. A time interval meter as in claim 9 wherein said adjustment means includes the microprocessor for comparing measurements of the calibration time interval to the known magnitude thereof, and also comprises a digital-to-analog converter responsive to said microprocessor and an operation amplifier coupled to the output of said digital-to-analog converter for supplying a reference voltage to adjust the current flowing through said first constant current source to thereby adjust the ratio of the first and second predetermined rates.

11. A time interval meter as in claim 9 wherein said sequential latch means comprises:

first, second, and third flip-flops coupled to said clock signal and operable for respectively outputting first, second, and third output signals equal to the respective logic states of first, second, and third input signals when said flip-flops are clocked, said first flip-flop is clocked at a rising edge of said clock signal, said second and third flip-flops are clocked at a falling edge of said clock signal, said flip-flops are interconnected such that said first output signal is equal to said second input signal, and one of said first output signal and said second output signal is equal to said third input signal, wherein said first input signal is equal to said start signal and said third output signal is equal to said stop signal; and switching means coupled to said select signal for connecting one of said first output signal and said second output signal to said third flip-flop to form said third input signal, wherein said first elapsed time interval occurs when said first output signal is connected to said third input signal and said second elapsed time interval occurs when said second output signal is connected to said third input signal, and wherein said elapsed time interval is the time between a rising edge of said first input signal and a rising edge of said third output signal.

12. A time interval meter as in claim 11 wherein each of the flip-flops are J-K type flip-flops having one of the input signals connected to the J input terminal thereof and a logic low voltage connected to the K input terminal thereof.

13. A time interval meter as in claim 11 wherein the switching means is a multiplexer having the first and second output signals connected to two input terminals thereof and having the third input signal connected to an output terminal thereof, said multiplexer is operable for connecting either said first output signal or said second output signal to said third input signal.

14. A method of calibrating a time interval meter, where said time interval meter is operable for measuring a time interval between the receipt of a start signal and the receipt of a stop signal by operating at a first predetermined rate during said ti me interval and by operating at a slower second predetermined rate to obtain a measure of said time interval that is proportional to the ratio of said first and second predetermined rates, said method comprising:

measuring a first elapsed time interval to provide a first measured value;

measuring a second elapsed time interval to provide a second measured value where said second elapsed time interval is equal to said first elapsed time interval plus one clock period of a constant frequency clock signal;

subtracting said first measured value from said second measured value to compute a measured clock period;

minimizing the difference between said measured clock period and said clock period by adjusting said ratio of said first and second predetermined rates.

15. A method as in claim 14 wherein the time interval meter includes a capacitor that is charged by a first constant current source to provide operation at the first predetermined rate and is discharged by a second constant current source to provide operation at the second predetermined rate, and wherein the step of adjusting said ratio of said first and second predetermined rates is accomplished by adjusting the current flow of said first constant current source.

16. A method as in claim 15 wherein the current flow of said first constant current source is automatically adjusted by an operational amplifier coupled to a digital-to-analog converter that is responsive to a microprocessor, where the microprocessor also performs the step of subtracting.

17. A method as in claim 15 wherein the difference between the measured clock period and the clock period is visually displayed and the current flow of said first constant current source is manually adjusted to minimize said difference.

18. A time interval meter for measuring a time interval between the receipt of a start signal and a pulse of a clock signal, said time interval meter comprising:

clocking means responsive to said clock and start signals for generating a stop signal at a pulse of said clock signal;

a dual speed ramp circuit coupled to said clocking means and operable at a fast ramp rate from a starting level for a fast ramp period from the receipt of said start signal to the receipt of said stop signal and operable at a slow ramp rate for a slow ramp period from the receipt of said stop signal until said starting level recurs, said slow ramp rate is proportionally slower than and opposite in sign to said fast ramp rate, the duration of said fast ramp period equals the time interval to be measured;

measurement means coupled to said dual speed ramp circuit for measuring the time duration of said slow ramp period and for computing a measured time interval equal to the duration of said slow ramp period times the ratio of said slow and fast ramp rates;

calibration means coupled to said clocking means for supplying a known time interval; and adjustment means for adjusting said ratio of said slow and fast ramp rates such that a measurement of said known time interval is equal to said known time interval.

19. A time interval meter as in claim 18 wherein the clocking means comprises first and third flip-flops with the start signal coupled to the input of said first flip-flop and the output of said third flip-flop containing said stop signal and coupled to the measurement means, and wherein the calibration means comprises a second flip-flop and a multiplexer with the output of said first flip-flop coupled to the input of said second flip-flop and to one input of said multiplexer, with the output of said second flip-flop coupled to the other input of said multiplexer, and with the output of said multiplexer coupled to the input of said third flip-flop so that said multiplexer is operable for selectively coupling the output of one of said first and second flip-flops to the input of said third flip-flop, and wherein said flip-flops are clocked by said clock signal such that the issuance of said stop signal is delayed by a time equal to one clock period when said multiplexer connects the output of said second flip-flop to the input of said third flip-flop.

20. A time interval meter as in claim 19 wherein the known time interval is equal to one clock period, and wherein the calibration means further comprises computation means for calculating a measurement of said known time interval equaling the difference between two measured time intervals, one of which is obtained with the multiplexer connecting the output of the first flip-flop to the input of the third flip-flop and the other of which is obtained with the multiplexer connecting the output of the second flip-flop to the input of the third flip-flop, and also comprises comparison means for comparing said known time interval to said measurement of said known time interval to determine a calibration error.

21. A time interval meter as in claim 20 wherein the dual speed ramp circuit comprises a capacitor and first and second constant current sources coupled to said capacitor for respectively charging and discharging said capacitor, and wherein the fast and slow ramp rates are proportional to the currents of said first and second constant current sources, respectively.

22. A time interval meter as in claim 21 wherein the adjustment means comprises means for automatically adjusting the fast ramp rate to minimize the calibration error.

23. A time interval meter as in claim 22 wherein the computation means and the comparison means is a microprocessor for providing a digital representation of the calibration error, and wherein the adjustment means is a digital-to-analog converter coupled to said microprocessor for converting said digital representation of the calibration error into an analog control voltage, where the current of the first constant current source is responsive to said analog control voltage.

24. A time interval meter as in claim 21 wherein the adjustment means comprises means for manually adjusting the fast ramp rate to minimize the calibration error.

25. A time interval meter as in claim 24 wherein the calibration means further comprises display means for visually displaying the calibration error, and wherein the adjustment means is a variable resistor coupled to the first constant current source.

* * * * *